US007823630B2

(12) United States Patent
Itoh et al.

(10) Patent No.: US 7,823,630 B2
(45) Date of Patent: Nov. 2, 2010

(54) TUBE FOR HEAT EXCHANGER AND METHOD OF MANUFACTURING TUBE

(75) Inventors: Tomohiro Itoh, Anjo (JP); Takayuki Nagai, Kariya (JP)

(73) Assignee: Denso Corporation, Kariya (JP)

( * ) Notice: Subject to any disclaimer, the term of this patent is extended or adjusted under 35 U.S.C. 154(b) by 231 days.

(21) Appl. No.: 12/080,436

(22) Filed: Apr. 2, 2008

(65) Prior Publication Data

US 2008/0245513 A1 Oct. 9, 2008

(30) Foreign Application Priority Data

Apr. 3, 2007 (JP) ..... 2007-097417

(51) Int. Cl.
*F28F 1/00* (2006.01)

(52) U.S. Cl. ..... 165/177; 138/38; 29/890.045; 29/890.053

(58) Field of Classification Search ..... 165/177–178, 165/183; 138/38; 29/890.053, 890.049
See application file for complete search history.

(56) References Cited

U.S. PATENT DOCUMENTS

| | | | | |
|---|---|---|---|---|
| 2,373,218 | A * | 4/1945 | Arnold | 138/38 |
| 2,757,628 | A * | 8/1956 | Johnston | 29/890.047 |
| 5,441,106 | A * | 8/1995 | Yukitake | 165/183 |
| 6,640,886 | B2 * | 11/2003 | Lamich | 165/174 |
| 7,117,936 | B2 * | 10/2006 | Ohata et al. | 165/183 |
| 2002/0005281 | A1 * | 1/2002 | Krupa et al. | 165/177 |
| 2005/0006082 | A1 * | 1/2005 | Brost et al. | 165/177 |
| 2009/0020278 | A1 * | 1/2009 | Zobel et al. | 165/177 |
| 2009/0050306 | A1 * | 2/2009 | Helms et al. | 165/183 |
| 2009/0193804 | A1 * | 8/2009 | Ohno et al. | 60/516 |

FOREIGN PATENT DOCUMENTS

EP 0 302 232 2/1989

(Continued)

OTHER PUBLICATIONS

Office action dated Sep. 25, 2009 in corresponding Chinese Application No. 2008 10081810.9.

(Continued)

*Primary Examiner*—Terrell L McKinnon
(74) *Attorney, Agent, or Firm*—Harness, Dickey & Pierce, PLC

(57) ABSTRACT

A tube for a heat exchanger is constructed of a single plate having one end portion and the other end portion in a width direction perpendicular to a tube longitudinal direction. The single plate having opposite first and second wall surfaces is bent to have a protruding portion at a position adjacent to the one end portion in the width direction and a contact portion adjacent to the protruding portion in the width direction. The protruding portion is configured to continuously extend in the longitudinal direction and to have a protruding tip on a side of the first wall surface, and the protruding tip contacts the first wall surface of a portion along the longitudinal direction. The second wall surface at the one end portion and the contact portion contacts the first wall surface at the other end portion and a position near the other end portion, respectively.

20 Claims, 5 Drawing Sheets

FOREIGN PATENT DOCUMENTS

| | | | | |
|---|---|---|---|---|
| EP | 302 232 | * | 2/1989 | ..... 165/177 |
| JP | 06-123571 | | 5/1994 | |
| JP | 10-047875 | | 2/1998 | |
| JP | 11-101586 | | 4/1999 | |
| JP | 2003-202196 | | 7/2003 | |
| JP | 2004-276070 | | 10/2004 | |

OTHER PUBLICATIONS

Office action dated Nov. 5, 2008 in Japanese Application No. 2007-097417 with English translation thereof.

Office action dated Jul. 13, 2010 in corresponding Chinese Application No. 2008 10081810.9.

* cited by examiner

TUBE FOR HEAT EXCHANGER AND METHOD OF MANUFACTURING TUBE

CROSS REFERENCE TO RELATED APPLICATION

This application is based on Japanese Patent Application No. 2007-97417 filed on Apr. 3, 2007, the contents of which are incorporated herein by reference in its entirety.

BACKGROUND OF THE INVENTION

1. Field of the Invention

The present invention relates to a tube for a heat exchanger and a method of manufacturing a tube, in which a fluid for a heat exchange flows. The heat exchanger can be suitably used as a radiator for a vehicle, for example.

2. Description of the Related Art

In a vehicle having an internal combustion engine, a heat exchanger such as a radiator for cooling engine coolant of the internal combustion engine is generally provided. In the heat exchanger, a plurality of tubes in which the coolant flows are arranged so that heat exchange is performed between air passing through the heat exchanger and the coolant flowing in the tubes, thereby cooling the coolant.

For example, JP-A-10-47875 proposes a tube for the heat exchanger, in which a projection J20 is formed by bending at a center portion of a metal plate in a width direction of the metal plate, as shown in FIG. 5. In the tube shown in FIG. 5, opposite two inner surfaces of the projection J20 are brazed, and two end portions of the metal plate are brazed to the outside surfaces of the projection J20 in a thickness direction of the projection J20 so as to form an inner column portion J200.

In the tube shown in FIG. 5, the inner column portion J200 is provided to partition an inner space of the tube into two fluid passages, thereby improving pressure resistance in the tube. However, when the tube is bonded to a core plate of a tank, a heating process is performed in a state where the tube is inserted into a tube insertion hole of the core plate. In the heating process, a melted brazing material of the core plate flows into the inner column portion J200 from the portions X shown in FIG. 5 by a capillary action. The brazing material flowing into the inner column portion J200 flows toward a center portion of a core portion of the heat exchanger, and are used for bonding the tube and a fin of the core portion. In this case, a brazing material for bonding the tube and the core plate of the tank may become insufficient, thereby causing a brazing insufficient problem.

In a tube for a heat exchanger described in JP-A-2003-202196, as shown in FIG. 6, one end portion J11 of a metal plate is bent approximately in a U shape to form an inner column portion J200. A first brazing portion J2*a* is formed so that the inner column portion J200 is brazed to an inner surface of the tube at the first brazing portion J2*a*. Furthermore, the other end portion J12 of the metal plate is bent to be bonded to the inner column portion J200 at a second brazing portion J2*b*. In this case, because one position of the brazing portions J2*a*, J2*b* of the metal plate is exposed to an exterior of the tube, the brazing material entering into the inner column portion in the tube can be reduced. Accordingly, it can restrict a brazing material for brazing the tube and the core plate from being insufficient.

In the tube shown in FIG. 6, a length $L_{10}$ of the second brazing portion J2*b* is smaller than a length $L_{20}$ of the inner column portion J200. Therefore, a part of the inner column portion J200 has the sectional area of the single metal plate, thereby reducing a pressure resistance of the tube. In this case, a center portion of the tube may be deformed during a heating process.

SUMMARY OF THE INVENTION

In view of the foregoing problems, it is an object of the present invention to provide a tube for a heat exchanger and a method thereof, which can improve a pressure resistance and can be accurately brazed to a tank of the heat exchanger.

According to an aspect of the present invention, a tube for a heat exchanger for performing a heat exchange of a fluid includes a single plate having one end portion and the other end portion in a width direction that is perpendicular to a longitudinal direction of the tube. The single plate has a first wall surface for defining a tube inner space and a second wall surface opposite to the first wall surface. The single plate is bent to have a protruding portion protruding in a mountain shape at a position adjacent to the one end portion in the width direction, and a contact portion adjacent to the protruding portion in the width direction. Furthermore, the protruding portion is configured to continuously extend in the longitudinal direction and to have a protruding tip on a side of the first wall surface, and the protruding tip contacts the first wall surface of a wall portion along the longitudinal direction. In addition, the second wall surface of the one end portion contacts the first wall surface, at a position near the other end portion in the width direction, along the longitudinal direction, while the first wall surface of the other end portion contacts the second wall surface of the contact portion, along the longitudinal direction.

In a case where the tube is bonded to a tank of the heat exchanger by using a brazing material clad on the tank, the melted brazing material from the tank may enter into the tube by a capillary action. However, in the above tube, the melted brazing material only enters from a contact position where the other end portion of the single plate contacts the contact portion. Accordingly, it can prevent an insufficient bonding between the tube and the tank, thereby the tube can be accurately brazed to the tank.

The protruding portion can be used as an inner column portion in the tube. Because the protruding portion has a sectional dimension in the width direction, that is larger than two times of the wall thickness of the single plate, pressure resistance of the tube can be increased.

For example, the protruding portion has two tilt surfaces having approximately equal lengths. Furthermore, the protruding portion may be configured to partition the tube inner space into at least three space parts each of which extends in the longitudinal direction. In addition, the two tilt surfaces of the protruding portion may be configured to define approximately a triangular space therebetween. In the tube, the single plate may be bent to have a plurality of the protruding portions arranged in the width direction and extending in the longitudinal direction.

In the tube, the second wall surface of the one end portion may be positioned substantially on the same surface as the second wall surface of the contact portion. Furthermore, the protruding tip of the protruding portion may contact the first wall surface of the wall portion that is parallel to the second wall surface of the one end portion and the contact portion.

The single plate may be configured to have an outer surface portion on the second wall surface such that a fin of the heat exchanger is boned to the outer surface portion.

For example, a heat exchanger may include a plurality of the tubes and a tank extending in a direction perpendicular to a stack direction of the tubes to communicate with the tubes.

The tank may include a core plate having tube-insertion holes into which one side ends of the tubes are inserted. In this case, the tubes may be bonded to the core plate using a brazing material clad on the core plate.

According to another aspect of the present invention, a method of manufacturing a tube for a heat exchanger includes a step of bending a single plate to form a protruding portion protruding in a mountain shape at a position adjacent to one end portion in a width direction perpendicular to the longitudinal direction, and a step of further bending the other end side of the single plate in the width direction to be connected to an outer surface of one end side of the single plate. In the further bending step, an inner surface of the other end side of the single plate contacts the outer surface of the one end portion and the outer surface of a contact portion adjacent to the protruding portion in the width direction, while a protruding tip of the protruding portion contacts an inner surface of the single plate, along the longitudinal direction.

In a case where the tube is bonded to a tank of the heat exchanger by using a brazing material clad on the tank, the melted brazing material may enter into the tube by a capillary action. However, in the tube manufactured by the above method, the melted brazing material from the tank only enters from a contact position where the other end portion of the single plate contacts the contact portion. Accordingly, it can prevent an insufficient bonding between the tube and the tank, thereby the tube can be accurately brazed to the tank.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENT

Figure 1:
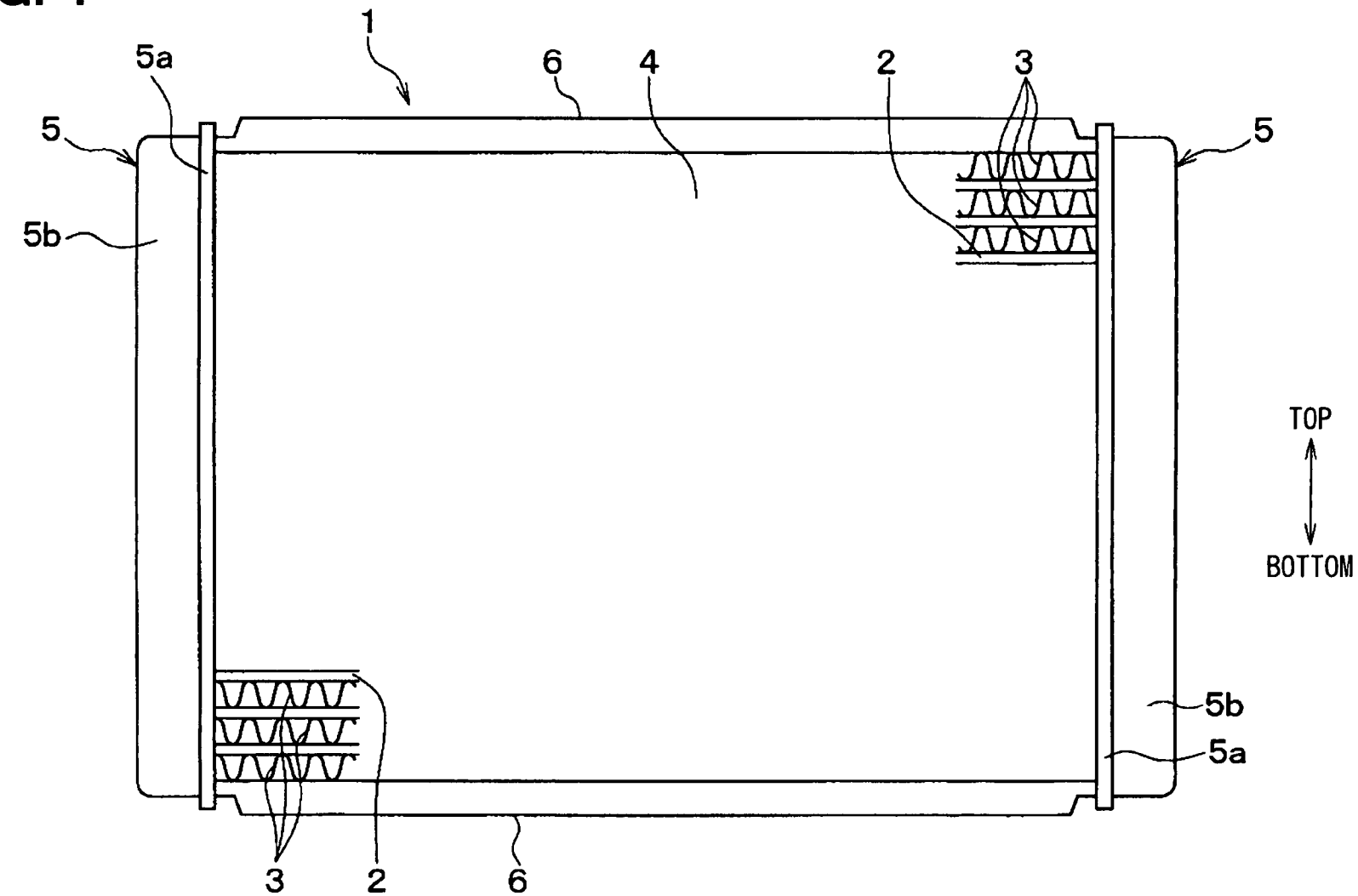
FIG. 1 is a front view showing a radiator (i.e., heat exchanger) according to an embodiment of the present invention.
Figure 2:
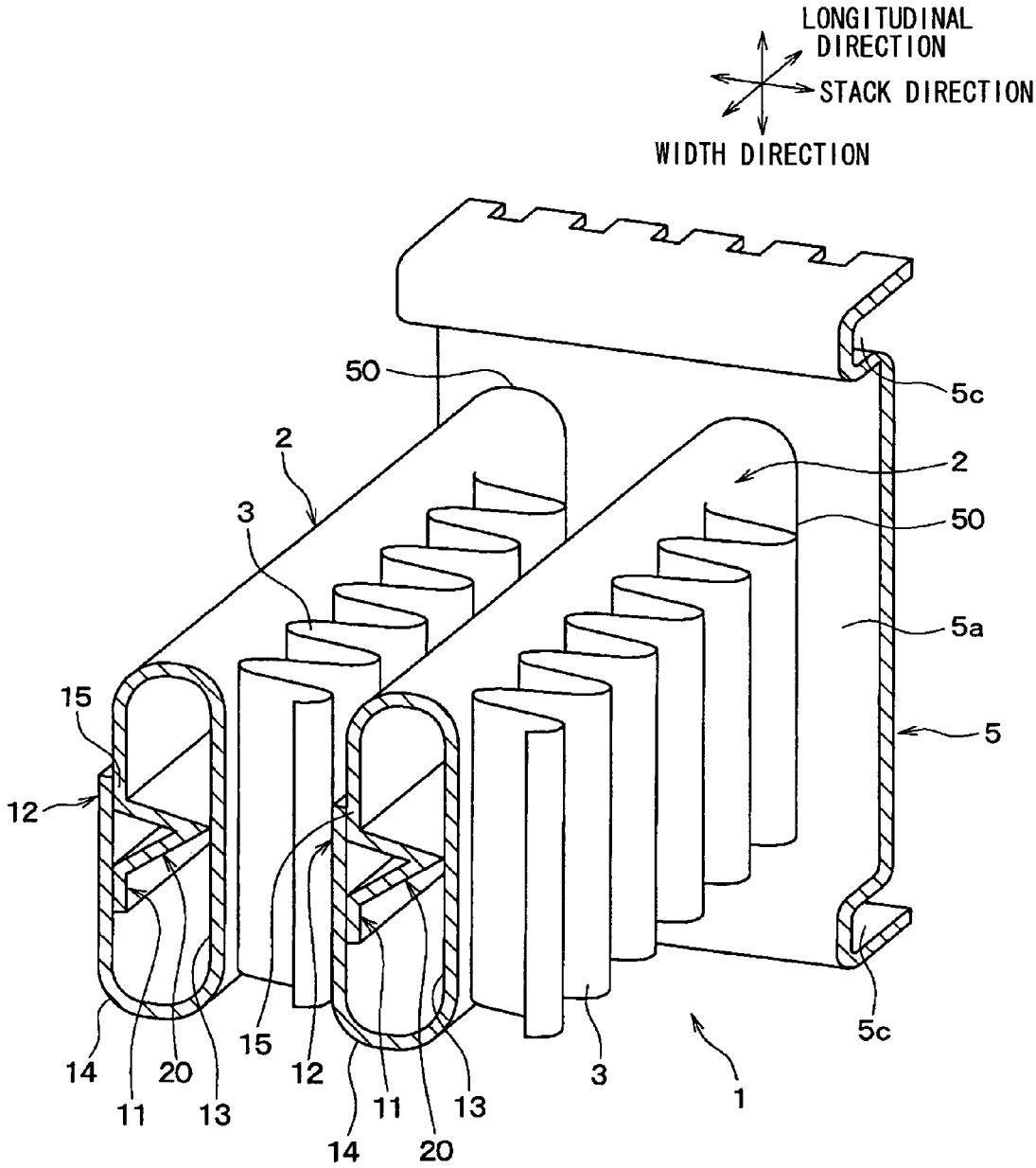
FIG. 2 is a partial-sectional perspective view showing a part of the heat exchanger according to the embodiment.

An embodiment of the present invention will be now described with reference to FIGS. 1 to 4H. In this embodiment, a tube 2 is typically used for a heat exchanger such as a radiator 1 in which engine coolant (thermal medium, fluid) is heat-exchanged with air. FIG. 1 shows an example of the radiator 1, and FIG. 2 shows tubes 2, fins 3 and a core plate 5*a* in a part of the radiator 1.

In the radiator 1 of FIG. 1, engine coolant flows in the tubes 2 which are stacked in a tube stack direction (stack direction). The tube 2 is a flat tube having an elliptic cross section, and each tube 2 is arranged such that a larger-diameter direction of the elliptic cross section of the tube 2 corresponds to the flow direction of air passing through the radiator 1. In the radiator 2, a plurality of the flat tubes 2 are stacked in the stack direction that corresponds to the top-bottom direction of FIG. 1. The flat tubes 2 are arranged parallel to each other, and each of the flat tubes 2 extends in a horizontal direction in FIG. 1.

Corrugated fins 3 are bonded to flat surfaces of each tube 2 outside the tube 2, so as to increase a heat transmission area with air. The tubes 2 and the corrugated fins 3 are alternately stacked in the stack direction to form a core portion 4 having approximately a rectangular shape. The core portion 4 is used as a heat exchanging portion in the radiator 1.

Two header tanks 5 are located at two end sides of the core portion 4 in a longitudinal direction of the tube 2 to communicate with the tubes 2. The header tank 5 extends in a direction perpendicular to the longitudinal direction of the tube 2. The header tank 5 includes a core plate 5*a* into which one side ends of the tubes 2 are inserted and bonded, and a tank body 5*b* connected with the core plate 5*a* to form a tank space. For example, in this embodiment, the core plate 5*a* is made of metal such as an aluminum material or an aluminum alloy, and the tank body 5*b* is made of resin.

As shown in FIG. 2, a recess portion 5*c* having approximately a U shape is provided in an entire peripheral portion of the core plate 5*a*, and a packing (seal member) made of an elastic material such as rubber is located in the recess portion 5*c*. A clearance between the tank body 5*b* shown in FIG. 1 and the core plate 5*a* can be tightly sealed by using the packing (not shown). A claw portion is provided at a periphery portion of the core plate 5*a* to stand, and is fastened to a flange formed at an outer periphery of the tank body 5*b*, thereby assembling the tank body 5*b* to the core plate 5*a*.

Inserts (i.e., side plates) 6 extending approximately in parallel with the longitudinal direction of the tube 2 are located at two end portions of the core portion 4 to reinforce the core portion 4.

Figure 3:
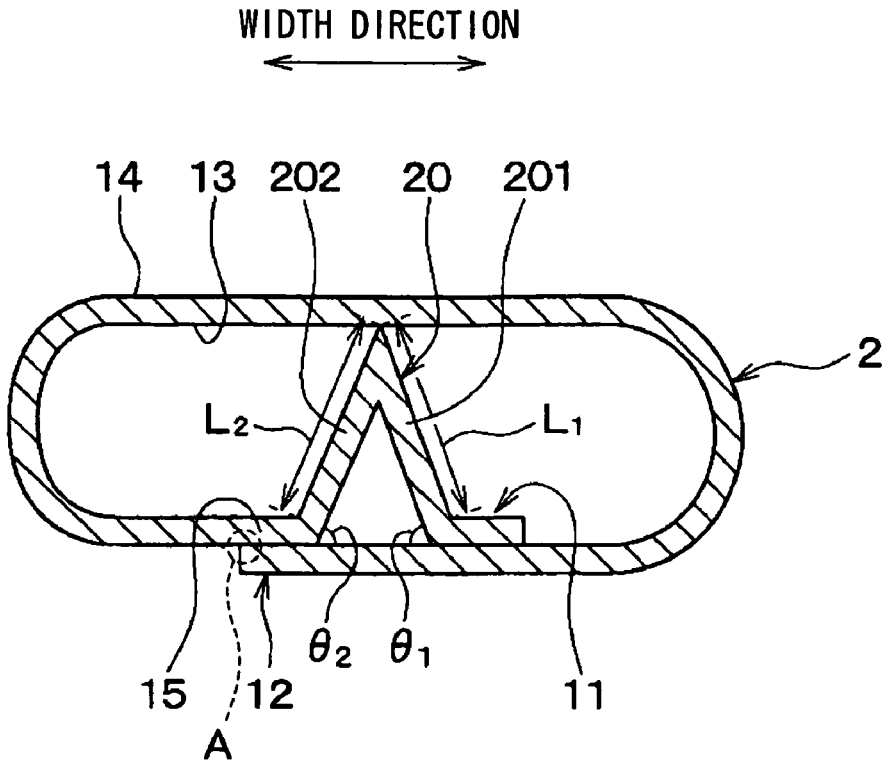
FIG. 3 is a cross-sectional view showing a tube according to the embodiment.

Next, the structure (e.g., shape) of the tube 2 will be described. FIG. 3 is a cross-sectional view showing the tube 2 of the embodiment. As shown in FIG. 3, a metal plate having one end portion 11 and the other end portion 12 in the width direction are bent to form the tube 2. A portion adjacent to the one end portion 11 in the width direction is bent in a mountain shape to form a protruding portion 20 protruding into an interior of the tube 2 and contact a first wall surface 13 (inner surface) of the tube 2. The protruding portion 20 extends in the longitudinal direction of the tube 2 to partition an interior of the tube 2 into three fluid passages separated from each other in the width direction. For example, the metal plate is made of an aluminum alloy.

The metal plate has a second wall surface 14 (outer surface) that is opposite to the first wall surface 13. The metal plate is bent such that the first wall surface 13 of the other end portion 12 contacts the second wall surface 14 of a contact portion 15 along the longitudinal direction of the tube 2. The contact portion 15 is positioned at the other side of the one end portion 11 relative to the protruding portion 20 in the width direction.

As shown in FIG. 3, the second wall surface 14 of the one end portion 11 positioned at one side of the protruding portion 20 in the width direction and the second wall surface 14 of the contact portion 15 positioned at the other side of the protruding portion 20 in the width direction contact the first wall surface 13 of the tube 2, respectively. In this embodiment, the protruding portion 20 having an inverse V-shape in cross section is used as an inner column portion which reinforces the tube 2 and partitions the interior of the tube 2 into the plural fluid passages (e.g., three fluid passages).

The protruding portion 20 is constructed of two tilt surfaces 201 and 202 to form the mountain shape. In this embodiment, the lengths of the tilt surfaces 201 and 202 are made generally equal, and the tilt angle θ1 of the tilt surface 201 relative to the second wall surface 14 of the one end portion 11 is made generally equal to the tilt angle θ2 of the tilt surface 201 relative to the second wall surface 14 of the contact portion 15.

Next, a method of manufacturing the tube 2 according to the embodiment will be described with reference to FIGS. 4A to 4H. The tube 2 is formed by a tube-forming machine having a plurality of forming rollers. A band-shaped metal plate extending in the tube longitudinal direction is plastically deformed to be bent as in the order shown in FIGS. 4A to 4H. Predetermined shapes are formed as shown in FIGS. 4A to 4H gradually.

Figure 4A:
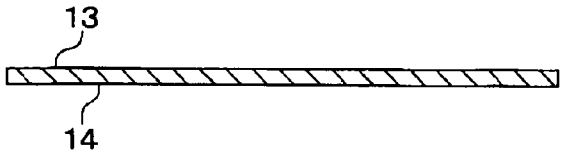
FIGS. 4A to 4H are cross-sectional views showing a method of manufacturing the tube, according to the embodiment.
Figure 4B:
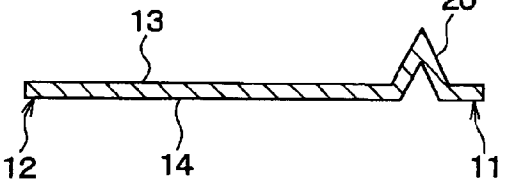

First, as shown in FIG. 4A, a flat metal plate clad with a brazing material on a surface (i.e., a surface corresponding to the second wall surface 14) is prepared. The back surface (i.e., a surface corresponding to the first wall surface 13) is not clad with a brazing material. That is, in FIG. 4A, only one surface of the flat metal plate is clad with the brazing material. Then, as shown in FIG. 4B, a protruding portion 20 having a reverse V-shape (i.e., mountain shape) is formed by bending a portion of the metal plate at a position near one end portion 11 of the metal plate in a width direction of the metal plate. In this embodiment, the width direction of the metal plate corresponds to the width direction of the tube 2. The protruding portion 20 protrudes to have a protrusion tip on a side of the first wall surface 13.

Figure 4C:
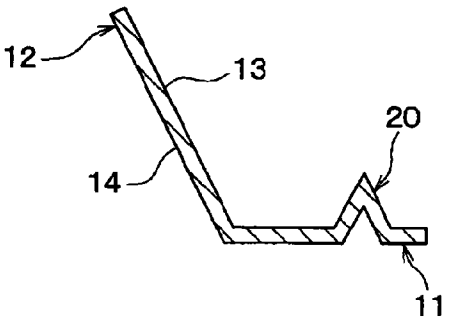
Figure 4D:
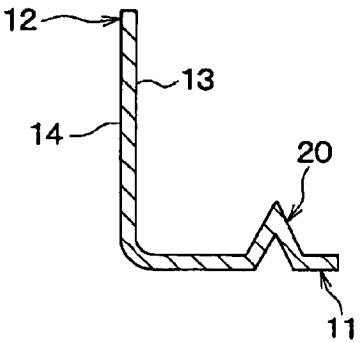
Figure 4E:
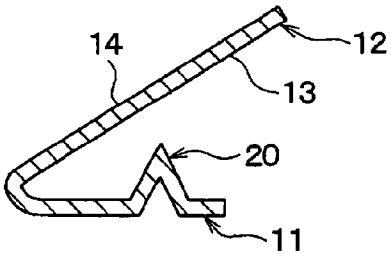
Figure 4F:
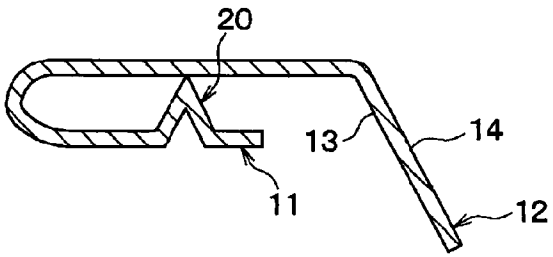

Next, as shown in FIGS. 4C to 4E, the other end side of the metal plate is bent such that the second wall surface 14 is positioned outside, with respect to the first wall surface 13. Then, as shown in FIG. 4F, the other end side of the metal plate is further bent such that the protruding tip of the protruding portion 20 contacts the first wall surface 13 at a wall portion facing the protruding portion 20.

Figure 4G:
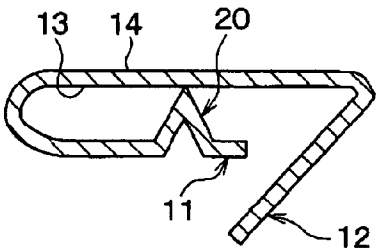
Figure 4H:
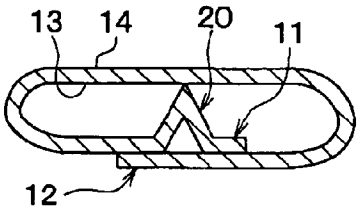
Figure 5:
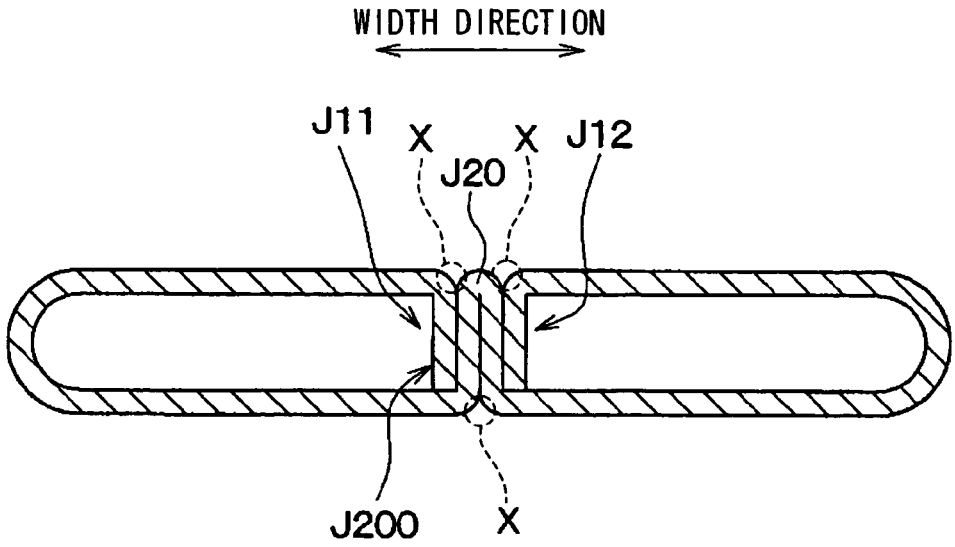
FIG. 5 is a cross-sectional view showing a tube of a prior art.
Figure 6:
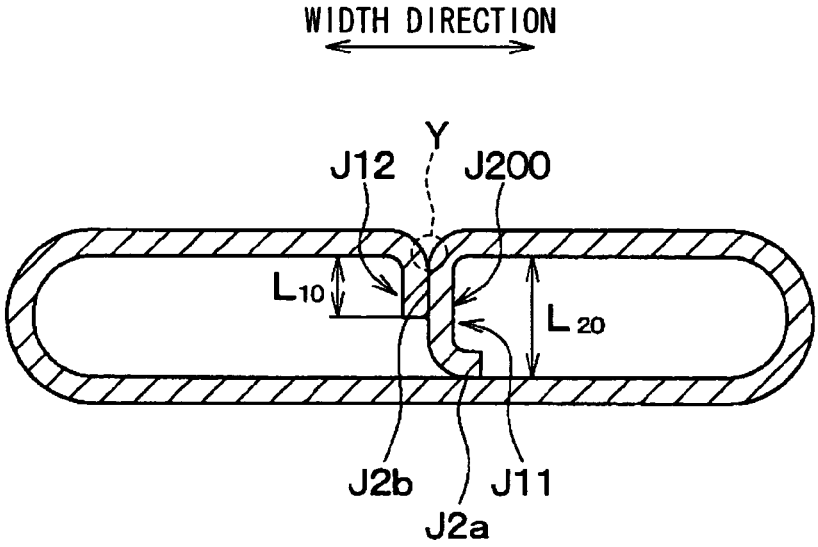
FIG. 6 is a cross-sectional view showing a tube of another prior art.

Then, as shown in FIGS. 4G and 4H, the other end portion 12 of the metal plate is further bent such that the first wall surface 13 of the other end portion 12 contacts the second wall surface 14 at the one end portion 11 and the contact portion 15. With this, the tube 2 having the protruding portion 20 therein is formed by bending a single plate.

A method of manufacturing the radiator 1 will be now described. First, a plurality of the tubes 2 each of which is formed by bending shown in FIGS. 4A to 4H, the core plate 5*a* clad with a brazing material on a side opposite to the core portion 4, fins 3 and inserts 6 are prepared, respectively.

Then, fins 3 are arranged between adjacent tubes 2 so as to form a core portion 4 that is assembled temporally. In the core portion 4, the tubes 2 are arranged to have a predetermined distance between adjacent two tubes 2 in the stack direction. Then, as shown in FIG. 2, the tubes 2 and the inserts 6 are inserted into through holes 50 of the core plate 5*a* of the header tank 5, so that the core plate 5*a*, the tubes 2, the fins 3 and the inserts 6 are temporally assembled.

The temporally assembled heat exchanger (radiator) is moved into a furnace, and is heated in the furnace. In the heating, the tubes 2, the inserts 6 and the core plates 5*a* are integrally brazed by using the brazing material clad on the core plate 5*a*, and the fins 3 are brazed to the outer surfaces of the tubes 2 by using brazing material clad on the second wall surfaces 14 of the tubes 2.

Then, the end portion of the tank body 5*b* is inserted into the recess portion 5*c* of the core plate 5*a*, and the claw portion of the core plate 5*a* is fixed and fastened to the flange formed at the outer periphery of the tank body 5*b*. Therefore, the tank body 5*b* is fixed to the core plate 5*a*, thereby forming the radiator 1.

When the brazing material clad on the core plate 5*a* is melted by heating, the melted brazing material flows toward an interior of the tube 2 from a brazing material entering portion A which corresponds to an outer portion in the contact portion 15 exposed to the outside of the tube 2.

In the above embodiment, the brazing material entering portion A is formed at one position where the other end portion 12 contacts the contact portion 15. Therefore, it can restrict the brazing material melted in the heating from flowing toward the interior of the tube 2 from the brazing material entering portion A. Thus, an insufficient of the brazing material for bonding the tube 2 to the core plate 5*a* can be prevented.

Furthermore, the protruding portion 20 having a reverse V shape is formed by bending the single metal plate to form the inner column portion within the tube 2. Therefore, a deformation of the tube 2 in the heating can be prevented. As a result, pressure resistance performance of the tube 2 can be improved, and the brazing can be accurately performed.

In the above-embodiment, because both the lengths of the tilt surfaces 201, 202 of the protruding portion 20 are made generally equal, the inner pressure of the tube 2 is not collected at one of the tilt surfaces 201, 202. That is, an isosceles triangle is formed by the tilt surfaces 201, 202 in the tube 2, thereby increasing pressure resistance of the tube 2.

According to an aspect of the above embodiment, the tube 2 for a heat exchanger for performing a heat exchange of a fluid includes a single plate having one end portion 11 and the other end portion 12 in a width direction that is perpendicular to the longitudinal direction of the tube 2. The single plate has the first wall surface 13 for defining a tube inner space and the second wall surface 14 opposite to the first wall surface 13. The single plate is bent to have the protruding portion 20 protruding in a mountain shape at a position adjacent to the one end portion 11 in the width direction, and the contact portion 15 adjacent to the protruding portion 20 in the width direction. Furthermore, the protruding portion 20 is configured to continuously extend in the longitudinal direction and to have a protruding tip on a side of the first wall surface 13, and the protruding tip contacts the first wall surface 13 of a wall portion along the longitudinal direction. In addition, the second wall surface 14 of the one end portion 11 contacts the first wall surface 13, at a position near the other end portion 12 in the width direction, along the longitudinal direction, while the first wall surface 13 of the other end portion 12 contacts the second wall surface 14 of the contact portion 15, along the longitudinal direction.

In a case where the tube 2 is bonded to the tank 5 by using a brazing material clad on the tank 5, the melted brazing material of the tank 5 may enter into the tube 2 by a capillary action from the contact position of the single plate. However, in the above tube 2, the melted brazing material only enters from the contact position where the other end portion 12 of the single plate contacts the contact portion 15. Accordingly, it can prevent an insufficient bonding between the tube 2 and the tank 5, thereby the tube 2 can be accurately brazed to the tank 5.

The protruding portion 20 can be used as an inner column portion in the tube 20. Because the protruding portion 20 has a sectional dimension in the width direction, that is larger than two times of the wall thickness of the single plate. Therefore, pressure resistance in the tube 2 can be increased.

For example, the protruding portion 20 has the two tilt surfaces 201, 202 having approximately equal lengths L1, L2. Accordingly, the protruding portion 20 may be configured to partition the tube inner space into at least three space parts each of which extends in the longitudinal direction. In addition, the two tilt surfaces 201, 202 of the protruding portion 20 may be configured to define approximately a triangular space therebetween. In the tube 2, the single plate may be bent to have a plurality of the protruding portions 20 (not shown) arranged in the width direction of FIG. 3 and extending in the longitudinal direction.

In the tube 2, the second wall surface 14 of the one end portion 11 may be positioned substantially on the same surface as the second wall surface 14 of the contact portion 15. Furthermore, the protruding tip of the protruding portion 20 may contact the first wall surface 13 of the wall portion that is parallel to the second wall surface 14 of the one end portion 11 and the contact portion 15.

According to another aspect of the embodiment, a method of manufacturing a tube 2 for a heat exchanger includes a step of bending a single plate to form a protruding portion 20 protruding in a mountain shape at a position adjacent to one end portion 11 in a width direction, and a step of further bending the other end side of the single plate in the width direction to be connected to an outer surface of one end side of the single plate. In the further bending step, an inner surface of the other end side of the single plate contacts the outer surface of the one end portion and the outer surface of a contact portion 15 adjacent to the protruding portion 20 in the width direction, while a protruding tip of the protruding portion 20 contacts an inner surface of the single plate, along the longitudinal direction.

In a case where the tube 2 is bonded to the tank 5 of the heat exchanger by using a brazing material clad on the tank 5, the melted brazing material may enter into the tube 2 by a capillary action. However, in the tube 2 manufactured by the above method, the melted brazing material only enters from a contact position where the other end portion 12 of the single plate contacts the contact portion 15. Accordingly, an insufficient bonding between the tube 2 and the tank 5 can be prevented, thereby the tube 2 can be accurately brazed to the tank 5.

Other Embodiments

Although the present invention has been fully described in connection with the preferred embodiment thereof with reference to the accompanying drawings, it is to be noted that various changes and modifications will become apparent to those skilled in the art.

In the above-described embodiment, the single protruding portion 20 having the mountain shape is formed by using the metal plate within the tube 2. However, plural protruding portions 20 may be formed in the tube 2 to be arranged in the width direction.

In the above-described embodiment, the lengths of the two tilt surfaces 201, 202 of the protruding portion 20 are made equal. However, the two tilt surfaces 201, 202 of the protruding portion 20 may be made to be different from each other. Furthermore, the protruding portion 20 may have a shape other than the reverse V shape.

In the above embodiment, the tube 2 is a flat tube having two opposite flat surfaces. However, the tube 2 may be a tube having an approximately round outer wall surface, or may be a tube having the other sectional shape.

In the above-described embodiment, the tube 2 is typically used for the radiator 1. However, the tube 2 may be used for other heat exchanger in which a thermal medium (fluid) inside the tube 2 is heat exchanged with a fluid outside the tube 2.

Such changes and modifications are to be understood as being within the scope of the present invention as defined by the appended claims.

What is claimed is:

1. A tube for a heat exchanger for performing a heat exchange of a fluid, the tube extending in a longitudinal direction and comprising a single plate having a first end portion and a second end portion opposite to the first end portion in a width direction that is perpendicular to the longitudinal direction, wherein:

the single plate has a first wall surface defining a tube inner space and a second wall surface opposite to the first wall surface;

the single plate is bent to have a protruding portion protruding in a mountain shape at a position adjacent to the first end portion in the width direction, and first and second planar contact portions at opposite sides of the protruding portion in the width direction;

the protruding portion is configured to continuously extend in the longitudinal direction and to have a protruding tip on a side of the first wall surface, the protruding tip contacting the first wall surface of a wall portion along the longitudinal direction;

the second wall surface of the first end portion contacts the first wall surface, at a position near the second end portion in the width direction, along the longitudinal direction;

the first wall surface of the second end portion contacts the second wall surface of the contact portion, along the longitudinal direction;

the first planar contact portion extends along the first end portion; and the first surface of the second end portion flat-contacts the second wall surfaces of both the first and second planar contact portions, along the longitudinal direction.

2. The tube for a heat exchanger according to claim 1, wherein the protruding portion has two tilt surfaces having approximately equal lengths.

3. The tube for a heat exchanger according to claim 1, wherein the protruding portion is configured to partition the tube inner space into at least three space parts each of which extends in the longitudinal direction.

4. The tube for a heat exchanger according to claim 1, wherein the protruding portion has two tilt surfaces which are configured to define approximately a triangular space therebetween.

5. The tube for a heat exchanger according to claim 1, wherein the single plate is bent to have a plurality of the protruding portions arranged in the width direction and extending in the longitudinal direction.

6. The tube for a heat exchanger according to claim 1, wherein the single plate is clad with a brazing material only on the second wall surface.

7. The tube for a heat exchanger according to claim 1, wherein the single plate is configured to have an outer surface portion on the second wall surface such that a fin of the heat exchanger is bonded to the outer surface portion.

8. The tube for a heat exchanger according to claim 1, wherein the protruding portion is positioned between the first end portion and the second planar contact portion in the width direction.

9. The tube for a heat exchanger according to claim 1, wherein the second wall surface of the first end portion is positioned substantially on the same surface as the second wall surface of the first planar contact portion.

10. The tube for a heat exchanger according to claim 9, wherein the protruding tip of the protruding portion contacts the first wall surface of the wall portion that is parallel to the second wall surface of the first end portion and the first planar contact portion.

11. A heat exchanger comprising:

a plurality of the tubes according to claim 1; and a tank extending in a direction perpendicular to a stack direction of the tubes to communicate with the tubes, wherein:

the tank includes a core plate having tube-insertion holes into which one side ends of the tubes are inserted; and the tubes are bonded to the core plate using a brazing material clad on the core plate.

12. The heat exchanger according to claim 11, further comprising a plurality of fins each of which is located between adjacent tubes to be bonded to the tubes.

13. A method of manufacturing a tube for a heat exchanger for performing a heat exchange of a fluid, the method comprising bending a single plate to form a protruding portion protruding in a mountain shape at a position adjacent to a first end portion in a width direction perpendicular to the longitudinal direction and to form first and second planar contact portions being defined on an outer surface of the first end portion on opposite sides of the protruding portion extending along the first end portion; and further bending a second end portion of the single plate opposite to the first end portion in the width direction to be connected to the outer surface of the first end portion of the single plate, wherein:

in the further bending, an inner surface of the second end portion of the single plate flat-contacts the first and second planar contact portions of the first end portion adjacent to the opposite sides of the protruding portion in the width direction, while a protruding tip of the protruding portion contacts an inner surface of the single plate, along the longitudinal direction.

14. The method according to claim 13, wherein the first and second planar contact portions are formed coplanar.

15. The tube for a heat exchanger according to claim 1, wherein the first planar contact portion extends along a terminal end of the one end portion.

16. The tube for a heat exchanger according to claim 1, wherein the first and second planar contact portions are immediately adjacent the protruding portion.

17. The tube for a heat exchanger according to claim 1, wherein the first and second planar contact portions are coplanar.

18. The tube for a heat exchanger according to claim 1, wherein the protruding portion comprises a pair of walls extending from the one end portion to the protruding tip, the first and second planar contact portions being disposed immediately adjacent the pair of walls at the one end portion.

19. The tube for a heat exchanger according to claim 1, wherein the protruding portion includes two tilt surfaces which are configured to define an approximate isosceles triangle with the first wall surface of the second end portion.

20. The tube for a heat exchanger according to claim 1, wherein only one protruding portion is provided.

* * * * *